US007190926B2

(12) United States Patent
Ebe

(10) Patent No.: US 7,190,926 B2
(45) Date of Patent: Mar. 13, 2007

(54) DEVELOPER BEARING BODY AND IMAGE FORMING APPARATUS

(75) Inventor: Takaaki Ebe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 169 days.

(21) Appl. No.: 11/094,716

(22) Filed: Mar. 30, 2005

(65) Prior Publication Data

US 2005/0226659 A1 Oct. 13, 2005

(30) Foreign Application Priority Data

Apr. 7, 2004 (JP) ..... 2004-112815

(51) Int. Cl.
*G03G 15/08* (2006.01)

(52) U.S. Cl. ..... 399/286

(58) Field of Classification Search ..... 399/279, 399/286; 492/28

See application file for complete search history.

(56) References Cited

U.S. PATENT DOCUMENTS 4,958,193 A * 9/1990 Nojima et al. ..... 399/286
5,741,616 A * 4/1998 Hirano et al. ..... 430/101
6,714,754 B2 * 3/2004 Ozeki et al. ..... 399/286

FOREIGN PATENT DOCUMENTS

JP 11-295979 A 10/1999

* cited by examiner

*Primary Examiner*—Hoang Ngo
(74) *Attorney, Agent, or Firm*—Akin Gump Strauss Hauer & Feld, LLP

(57) ABSTRACT

In an electrophotographic image forming apparatus, a contact-type developing roller contacts a photosensitive drum, a developing blade, a supply roller or the like. If the surface of the developing roller is excessively hard, there is a possibility that a pressure applied between the developing roller and the photosensitive drum or the like may increase, and may cause a filming, i.e., a phenomena in which a toner is degraded and welded to the surface of the developing roller. The filming can be prevented when a JIS-A hardness $H_A$ (degree) of a resilient layer of the developing roller and a dynamic hardness $H_S$ (mN/μm$^2$) of a surface layer of the developing roller satisfy the following relationship: $H_A \times H_S < 15$.

12 Claims, 5 Drawing Sheets

DEVELOPER BEARING BODY AND IMAGE FORMING APPARATUS

BACKGROUND OF THE INVENTION

This invention relates to an image forming apparatus (such as a copier or a printer) using electrophotographic technology, and more particularly to a developer bearing body used in a developing device of the image forming apparatus.

Conventionally, an image forming apparatus (such as a printer or a copier) is configured to form an image on a recording medium by electrophotographic processes. In a charging process, a photosensitive drum is charged. In an exposing process, a latent image is formed on the photosensitive body according to image data. In a developing process, the latent image on the photosensitive drum is developed (visualized) with toner. In a transferring process, the developed toner image is transferred to a recording medium such as a paper. In a fixing process, the toner image is fixed to the recording medium by means of heat and pressure.

In such an electrophotographic image forming apparatus, the size of a printable pixel is reduced, in order to precisely reproduce an image and to enhance the image quality. For this purpose, a polymerized toner which is uniform in shape and size (and therefore suitable for enhancing the image quality) is recently used as a developer, instead of a pulverized toner which is nonuniform in shape and size and has a broad distribution of charge.

A developing roller used in the developing process includes a core made of stainless steel or the like, and a resilient layer formed on the core and made of a resilient material such as silicone rubber or urethane rubber. In order to prevent the contamination and to enhance a quality of printing (for example, a quality of charging), the surface of the resilient layer is processed or coated in consideration of a combination with the toner or other components, as disclosed in Japanese Patent Kokai Publication No. 11-295979 (Pages 2–3, FIG. 1).

However, if the surface of the developing roller is processed or coated, there is a possibility that the surface of the developing roller may be hardened, depending on the condition of processing or coating (for example, a kind or an amount of material to be used) of the developing roller. In a contact-type developing device in which the developing roller contacts the photosensitive drum, the developing roller also contacts a developing blade and a toner supply roller. If the surface of the developing roller is excessively hard, the pressure between the developing roller and contact members (i.e., the developing blade, the toner supply roller and the photosensitive drum) may increase, with the result that a filming may occur.

SUMMARY OF THE INVENTION

An object of the present invention is to provide a developer bearing body and an image forming apparatus capable of preventing a filming.

The present invention provides a developer bearing body that supplies a developer to a latent image formed on a latent image bearing body. The developer bearing body includes a rotation shaft, a resilient layer covering the rotation shaft, and a surface layer covering the resilient layer. A JIS-A hardness $H_A$ (degree) of the resilient layer and a dynamic hardness $H_S$ (mN/μm$^2$) of the surface layer satisfy the following relationship: $H_A \times H_S < 15$.

The present invention also provides a developer bearing body having a cylindrical shape and being rotatable about a rotation axis to supply a developer to a latent image formed on a latent image bearing body. The developer bearing body includes a resilient layer covering the rotation axis, and a surface layer covering the resilient layer. The surface layer has grooves formed on a surface thereof and extending substantially in a circumferential direction thereof. A JIS-A hardness $H_A$ (degree) of the resilient layer and a dynamic hardness $H_S$ (mN/μm$^2$) of the surface layer satisfy the following relationship: $H_A \times H_S < 20$.

With such an arrangement, the hardness of the resilient layer and the hardness of the surface layer can be kept in suitable ranges, with the result that the occurrence of the filming can be prevented.

DETAILED DESCRIPTION OF THE PREFERRED EMBODIMENT

Embodiments of the present invention will be described with reference to the attached drawings.

Embodiment 1

Figure 1:
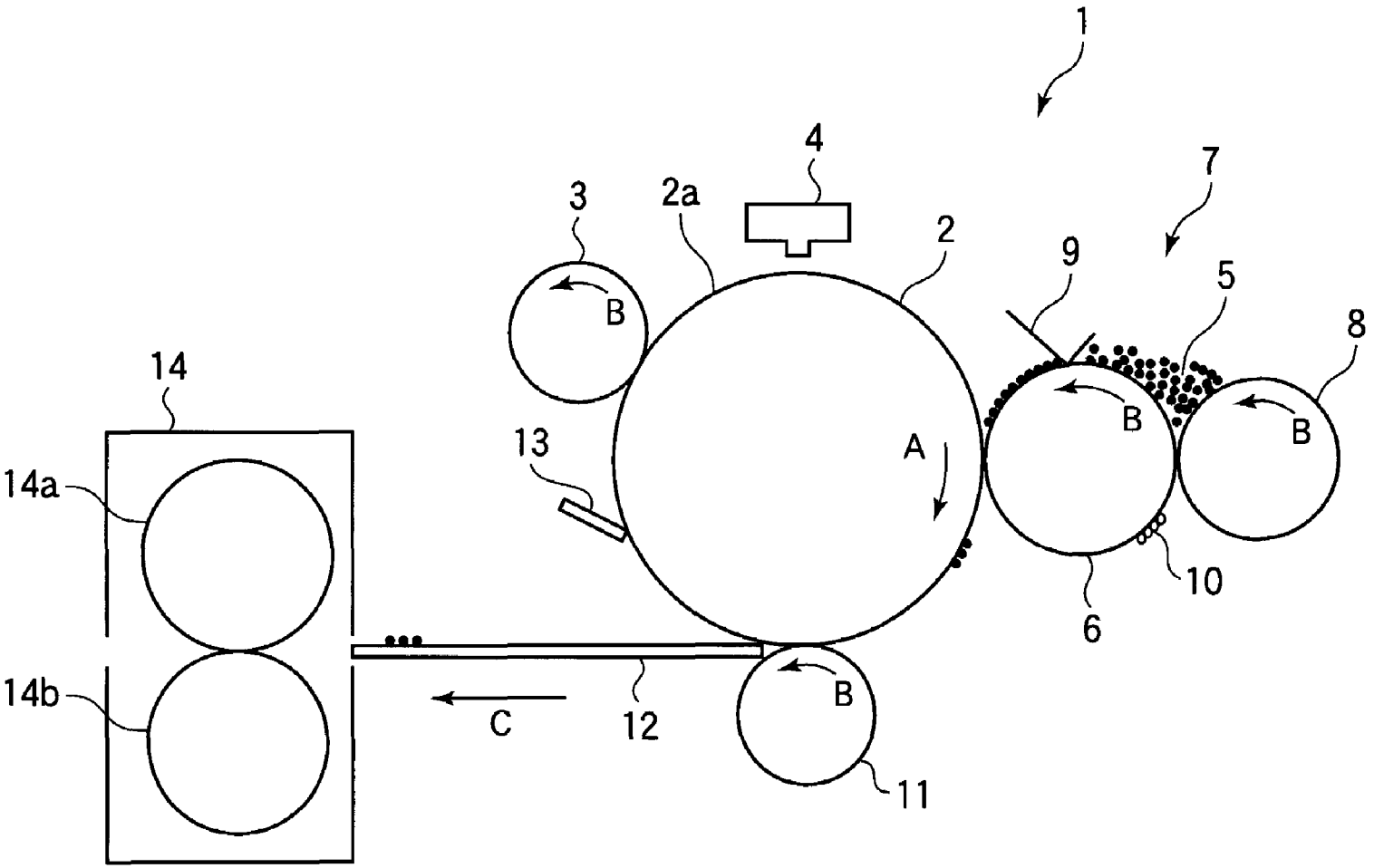
FIG. 1 is a sectional view of an image forming apparatus having a developing roller as a developer bearing body according to Embodiment 1 of the present invention.

FIG. 1 is a sectional view of a main part of an image forming apparatus 1 having a developing roller as a developer bearing body according to Embodiment 1 of the present invention.

Figure 2:
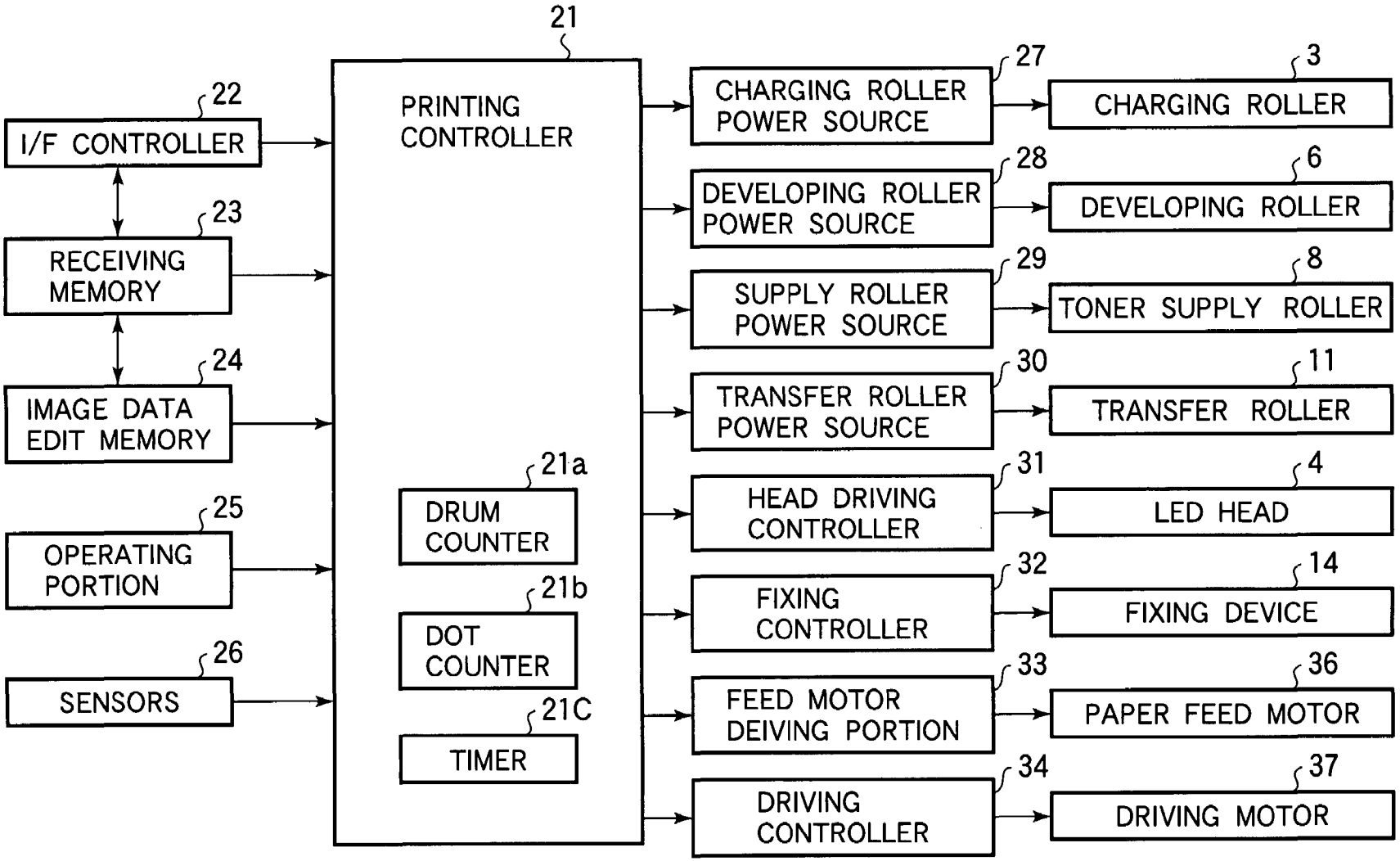
FIG. 2 is a block diagram showing a main part of a control system of an image forming apparatus according to Embodiment 1 of the present invention.

In FIG. 1, a photosensitive drum (i.e., a latent image bearing body) 2 is mounted on a not shown chassis together with a driving motor 37 (FIG. 2). The photosensitive drum 2 is rotated by the driving motor 37 in the direction indicated by an arrow A. Along the circumference of the photosensitive drum 2, a charging roller 3, an LED (Light Emitting Diode) head 4, and a developing roller 6 are arranged in this order in the rotational direction of the photosensitive drum 2. The charging roller 3 uniformly charges the peripheral surface 2*a* of the photosensitive drum 2. The LED head 4 irradiates the peripheral surface 2*a* of the photosensitive drum 2 with the image light, to form a latent image. The developing roller (i.e., the developer bearing body) 6 supplies a toner (i.e., a developer) 5 to the latent image. The charging roller 3 is urged against the photosensitive drum 2 and rotates together with the photosensitive drum 2. A predetermined voltage is applied to the charging roller 3 by a charging roller power source 27 (FIG. 2), so that the charging roller 3 is uniformly charged.

The developing roller 6 constitutes a part of a developing device 7. The developing device 7 further includes a toner supply roller 8, a not shown toner cartridge, a developing blade 9, a developing roller power source 28 (FIG. 2) and a supply roller power source 29 (FIG. 2) described later. The toner supply roller 8 supplies the toner 5 to the developing roller 6. The toner cartridge stores the toner therein, and supplies the toner to the toner supply roller 8 and the developing roller 6. The developing blade 9 forms a thin layer of the toner on the surface of the developing roller 6. The developing roller power source 28 (FIG. 2) applies a voltage to the developing roller 6 to charge the toner 5 with the same polarity as the electric potential of the charged surface of the photosensitive body 2. The toner supply roller 8 and the not shown toner cartridge constitute a developer supply unit. The developing blade 9 constitutes a thin layer forming member.

The developing device 7, the photosensitive drum 2 and the cleaning blade 13 constitute a process unit. The process unit, the transfer roller 11 and the fixing device 14 constitute the image forming apparatus 1.

A transfer roller 11 and a cleaning blade 13 are disposed on the downstream side (in the rotational direction of the photosensitive drum 2) of the developing roller 6. A predetermined force is applied to a rotation shaft of the transfer roller 11 by not shown springs, so that the peripheral surface of the transfer roller 11 is urged against the peripheral surface 2*a* of the photosensitive drum 2. A transfer roller power source 30 (FIG. 2) applies a voltage to the transfer roller 11 so that an electric charge whose polarity is opposite to the toner 5 is applied to the back side of a recording medium (for example, a paper) 12. The cleaning blade 13 scrapes the toner that remains on the peripheral surface 2*a* of the photosensitive drum 2 after the transferring, and removes the toner therefrom. The fixing device 14 includes a heating roller 14*a* and a backup roller 14*b*, and heats and presses the toner that has been transferred to the recording medium 12, to thereby fix the toner to the recording medium 12.

The whole operation of the above constructed image forming apparatus 1 will be described. The photosensitive drum 2 is rotated by the driving motor 37 (FIG. 2) in the direction indicated by the arrow A at a constant speed. Further, the developing roller 6, the toner supply roller 8, the charging roller 3 and the transfer roller 11 respectively rotate in directions indicated by arrows B. The peripheral surface 2*a* of the photosensitive drum 2 is uniformly charged by the charging roller 3. When the LED head 4 irradiates the peripheral surface 2*a* of the photosensitive drum 2 with the image light, the electric charge of the irradiated portion on the photosensitive drum 2 is released, and therefore a potential difference occurs between the irradiated portion and the non-irradiated portion, with the result that the latent image is formed on the photosensitive drum 2.

When the photosensitive drum 2 further rotates in the direction indicated by the arrow A, the latent image reaches the position where the latent image faces the developing roller 6 of the developing device 7. The toner 5, which has been charged to have the same polarity as the charged surface of the photosensitive drum 2, adheres to the latent image (i.e., the portion irradiated with the image light) to visualize the latent image. The residual toner 10 may remain on the surface of the developing roller 6.

The transfer roller 11 rotates in the direction indicated by the arrow B at the same circumferential speed as that of the photosensitive drum 2. As was described above, the transfer roller 11 is urged against the photosensitive drum 2 so that the transfer roller 11 and the photosensitive drum 2 sufficiently contact each other.

The recording medium 12 is supplied by a not shown paper supplying mechanism, and is fed to a contact portion between the photosensitive drum 2 and the transfer roller 11 by a not shown feeding mechanism in accordance with the timing of the rotation of the photosensitive drum 2. When the tip of the recording medium 12 reaches to the contact portion between the photosensitive drum 2 and the transfer roller 11, the recording medium 12 is sandwiched by the photosensitive drum 2 and the transfer roller 11 and is fed in the direction indicated by an arrow C, so that the recording medium 12 faces the toner image on the photosensitive drum 2. The timing of the feeding of the recording medium 12 is so set that a predetermined position of the recording medium 12 faces the toner image on the photosensitive drum 2.

When the transfer roller 11 feeds the recording medium 12, the transfer roller 11 applies the electric potential (whose polarity is opposite to the toner 5) to the back side of the recording medium 12. When the recording medium 12 faces the toner image on the photosensitive drum 2, the toner 5 is attracted by the electric charge whose polarity is opposite to the toner 5, and is transferred to the recording medium 12. The recording medium 12 on which the toner image is transferred is heated and pressed by the fixing device 14, so that the toner image is fixed to the recording medium 12. The residual toner that remains on the peripheral surface 2*a* of the photosensitive drum 2 after the transferring is removed by the cleaning blade 13, with the result that the printing operation is ended.

FIG. 2 is a block diagram of a main part (i.e., a part relating to Embodiment 1 of the present invention) of the control system of the image forming apparatus 1. The control system will be described with reference to FIG. 2.

As shown in FIG. 2, a printing controller 21 includes a microprocessor, a ROM, a RAM, an input/output port, a timer or the like. The printing controller 21 receives printing data and an control command from a not shown superior device via an interface controller (referred to as an I/F controller) 22, and carries out a printing operation to control the whole sequence of the image forming apparatus 1 (FIG. 1). A receive memory 23 temporally stores the printing data inputted by the superior device via the I/F controller 22. An image data edit memory 24 receives the printing data recorded in the receive memory 23, and stores image data, i.e., data formed by editing the printing data.

An operating portion 25 includes an LED that indicates a condition of the image forming apparatus 1, and a switch or the like for sending an instruction from an operator to the image forming apparatus 1. Sensors 26 include a various kinds of sensors for monitoring a condition of the image forming apparatus 1, such as a paper position detection sensor, a temperature/humidity detection sensor, a density sensor or the like.

The charging roller power source 27 applies the predetermined voltage to the charging roller 3 according to the instruction from the printing controller 21, so as to charge the photosensitive drum 2. The developing roller power source 28 applies the predetermined voltage to the developing roller 6 so that the toner adheres to the latent image. The supply roller power source 29 applies the predetermined voltage to the toner supply roller 8 so that the toner supply roller 8 supplies the toner 5 to the developing roller 6. The transfer roller power source 30 applies the predetermined voltage to the transfer roller 11 so that the toner image on the photosensitive drum 2 is transferred to the recording medium 12. The charging roller power source 27, the developing roller power source 28, the supply roller power source 29 and the transfer roller power source 30 are able to vary voltages thereof, according to the instruction from the printing controller 21.

A head driving controller 31 sends the image data recorded in the image data edit memory 24 to the LED head 4, and drives the LED head 4. A fixing controller 32 applies the predetermined voltage to the fixing device 14 for fixing the toner image (that has been transferred to the recording medium 12) to the recording medium 12. The fixing device 14 includes a not shown heater for melting the toner of the toner image on the recording medium 12, and a not shown temperature sensor for detecting the temperature or the like. The fixing controller 32 reads the output of the temperature sensor, and drives the heater according to the output of the temperature sensor, so as to keep constant the temperature of the heat roller 14*a* of the fixing device 14.

A feeding motor driving portion 33 drives a paper feed motor 36 to rotate, to thereby feed the recording medium 12. The feeding motor driving portion 33 feeds and stops the recording medium 12 at predetermined timings according to the instruction from the printing controller 21. The driving controller 34 drives the driving motor 37 for rotating the photosensitive drum 2. As shown in FIG. 1, when the driving motor 37 is driven by the driving controller 34, the photosensitive drum 2 rotates in the direction indicated by the arrow A, and the charging roller 3, the developing roller 6, the supply roller 8 and the transfer roller 11 respectively rotate in the directions indicated by the arrows B. A drum counter 21*a* counts the rotation of the photosensitive drum 2. A dot counter 21*b* counts the printing dots. A timer 21*c* measures various operating times.

The structure of the developing device 7 will be described with reference to FIG. 1. The developing roller 6 contacts the photosensitive drum 2 so that the developing roller 6 is pushed in the photosensitive drum 2 by an amount of 0.1 mm. The toner supply roller 8 is made of a silicone rubber in the shape of a sponge, whose ASKER F hardness is 50 degrees. The toner supply roller 8 contacts the developing roller 6 so that the toner supply roller 8 is pushed in the developing roller 6 by an amount of 1.5 mm. The developing blade 9 is made of a stainless steel whose thickness is 0.08 mm. The tip of the developing blade 9 is bent by an angle of 60 degrees. The radius of curvature of the surface of the bent portion facing the developing roller 6 is 0.18 mm. The bent portion of the developing blade 9 is urged against the developing roller 6 with a linear pressure of 5 g/mm. The toner 5 is a polymerized toner made of emulsion polymerization whose mean particle diameter is 7 μm or less.

Figure 3:
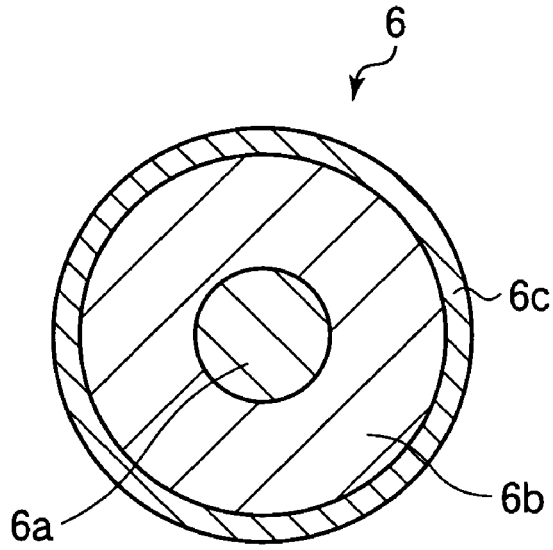
FIG. 3 is a sectional view showing an internal structure of the developing roller as the developer bearing body of Embodiment 1 of the present invention.

FIG. 3 is a sectional view showing the internal structure of the developing roller 6 as a developer bearing body according to Embodiment 1 of the present invention. As shown in FIG. 3, the developing roller 6 includes a core 6*a* (i.e., a rotation shaft) made of metal, a resilient layer 6*b* formed around the core 6*a*, and a surface layer 6*c* formed on the surface of the resilient layer 6*b*. The resilient layer 6*b* is made of a resilient rubber in which a suitable amount of electrical conductive material is dispersed so as to adjust the electric resistance of the resilient layer 6*b*. The surface layer 6*c* is made of urethane or the like as described later.

Next, an experiment with regard to the occurrence of the filming will be described. The filming is a phenomena in which the toner on the developing roller 6 is degraded and welded to the surface of the developing roller 6. In the experiment, the hardness of the resilient layer 6*b* and the surface layer 6*c* of the developing roller 6 are varied.

The filming on the surface of the developing roller 6 tends to occur easily when the contact member (for example, the photosensitive drum 2) keeps applying a pressure to the toner on the developing roller 6. Therefore, the evaluation of the filming is carried out after the continuous double-sided printing operation of 20,000 papers (A4-lateral). In the printing operation, a solid lateral stripe pattern whose duty is 1% (with respect to A4 paper) is used, in order to reduce the consuming amount of the toner. After the printing operation, the determination whether the filming of the toner on the developing roller 6 occurs or not is carried out by checking the surface of the developing roller 6 with naked eyes. An electron microscope is used when the naked eye checking is difficult.

Figure 4:
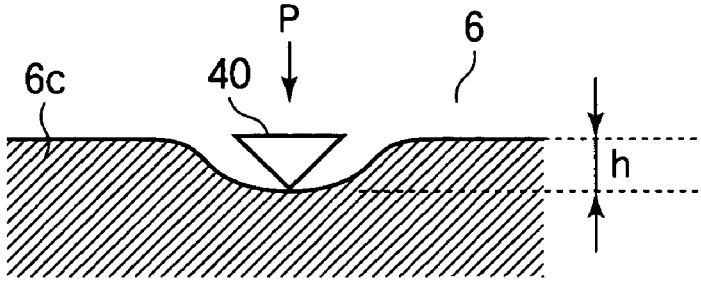
FIG. 4 is a schematic view illustrating a method for measuring a microhardness of the surface of the developing roller.

The method for measuring the microhardness of the surface of the developing roller 6 will be described with reference to FIG. 4. As a measuring device, "Dynamic Microhardness Meter DUH-W201" manufactured by Shimadzu Corporation is used. The microhardness meter measures the microhardness by pushing an indenter 40 in a work piece. The measurable range is from 0 to 10 μm, and therefore the thickness of the surface layer 6*c* (whose thickness is on the order of micron) can be measured without being influenced by the hardness of the resilient layer 6*b*. The indenter 40 of the microhardness meter is of Bercovici-type, and has the shape of a triangular pyramid whose dihedral angle is 115 degrees. The indenter 40 is pushed in the surface layer 6*c* of the developing roller 6 with a force P (mN), and a dynamic hardness $H_S$ (i.e., the microhardness) is calculated based on the depth h (μm) at which the indenter 40 is pushed in the surface layer 6*c* according to the following equation:

$$H_S = 3.858 \times P(\text{mN})/h^2\ (\mu m^2)$$

Three kinds of the developing rollers 6 are used in the experiment, which are respectively referred to as developing rollers A, B and C. The components of the developing rollers A, B and C are shown in Table 1. In each of the developing rollers A, B and C, the resilient layer 6*b* is made of silicone rubber. The surface layer 6c of the developing roller A is made of polyester urethane and has the thickness of 10 μm. The surface layer 6*c* of the developing roller B includes a first layer (10 μm) made of polyester urethane and a second layer (2 μm) made of silicone resin covering the first layer. The surface layer 6*c* of the developing roller C is made by mixing polyester urethane and silicone resin, and has the thickness of 10 μm. The components of developing rollers of comparative examples 1, 2, 3, 4 and 5 are also shown in Table 1. The developing rollers A, B and C and the developing rollers of the comparative examples 1 through 5 are collectively referred to as test developing rollers.

TABLE 1

| Developing Roller | Resilient Layer 6b | Surface Layer 6c |
|---|---|---|
| Developing Roller A | Silicone Rubber of JIS-A 50 Degrees | Polyester Urethane Layer (10 μm) is used. |
| Developing Roller B | Silicone Rubber of JIS-A 50 Degrees | Silicone Resin Layer (2 μm) is formed on Polyester Urethane (10 μm) used in Developing Roller A. |
| Developing Roller C | Silicone Rubber of JIS-A 40 Degrees | Polyester Urethane used in Developing Roller A and Silicone Resin used in Developing Roller B are mixed (10 μm). |
| Comparative Example 1 | Silicone Rubber of JIS-A 50 Degrees | Polyester Urethane used in Developing Roller A and Silicone Resin used in Developing Roller B are mixed (10 μm). |

TABLE 1-continued

| Developing Roller | Resilient Layer 6b | Surface Layer 6c |
|---|---|---|
| Comparative Example 2 | Silicone Rubber of JIS-A 50 Degrees | Silicone Resin Layer (2 μm) used in Developing Roller B is formed on Polyester Urethane Layer (10 μm) used in Developing Roller A to which 15 weight parts of Silica (particle size: 4 μm) is added. |
| Comparative Example 3 | Silicone Rubber of JIS-A 50 Degrees | Silicone Resin Layer (2 μm) used in Developing Roller B to which charge controlling agent is added is formed on Polyester Urethane Layer (10 μm) used in Developing Roller A to which 15 weight parts of Silica (particle size: 4 μm) is added. |
| Comparative Example 4 | Silicone Rubber of JIS-A 40 Degrees | Silicone Resin Layer (2 μm) used in Developing Roller B to which charge controlling agent is added is formed on Polyester Urethane Layer (10 μm) used in Developing Roller A to which 8 weight parts of Silica (particle size: 4 μm) is added. |
| Comparative Example 5 | Silicone Rubber of JIS-A 30 Degrees | Same as Comparative Example 3. |

Table 2 shows the result of the determination whether the filming occurs or not after the continuous printing is carried out using the test developing rollers. In Table 2, "O" indicates that the filming does not occur, and "X" indicates that the filming occurs. Table 2 also shows the hardness of the resilient layer 6*b* and the surface layer 6*a* of the test developing rollers. The hardness of the surface of each test developing roller is not univocally determined by a material used for processing or coating on the developing roller, but can be adjusted by varying the density of solvent, the thickness of the coating, the adding amount of the micro particles, or the like. In each of the test developing rollers shown in Table 1, a ten-point height of roughness profile $R_z$ is 6 μm, and a mean width of the profile elements Sm is 40 μm. The mean width of the profile elements Sm in the axial direction is the same as that in the circumferential direction, so that profile irregularities are uniformly distributed.

TABLE 2

| Developing Roller | JIS-A Hardness $H_A$ of Resilient Layer 6b (degrees) | Dynamic Hardness $H_s$ of Surface Layer 6c (mN/μm$^2$) | Occurrence of Filming |
|---|---|---|---|
| Developing Roller A | 50 | 0.14 | ○ |
| Developing Roller B | 50 | 0.20 | ○ |
| Developing Roller C | 40 | 0.35 | ○ |
| Comparative Example 1 | 50 | 0.35 | X |
| Comparative Example 2 | 50 | 0.30 | X |
| Comparative Example 3 | 50 | 0.58 | X |
| Comparative Example 4 | 40 | 0.44 | X |
| Comparative Example 5 | 30 | 0.58 | X |

Figure 5:
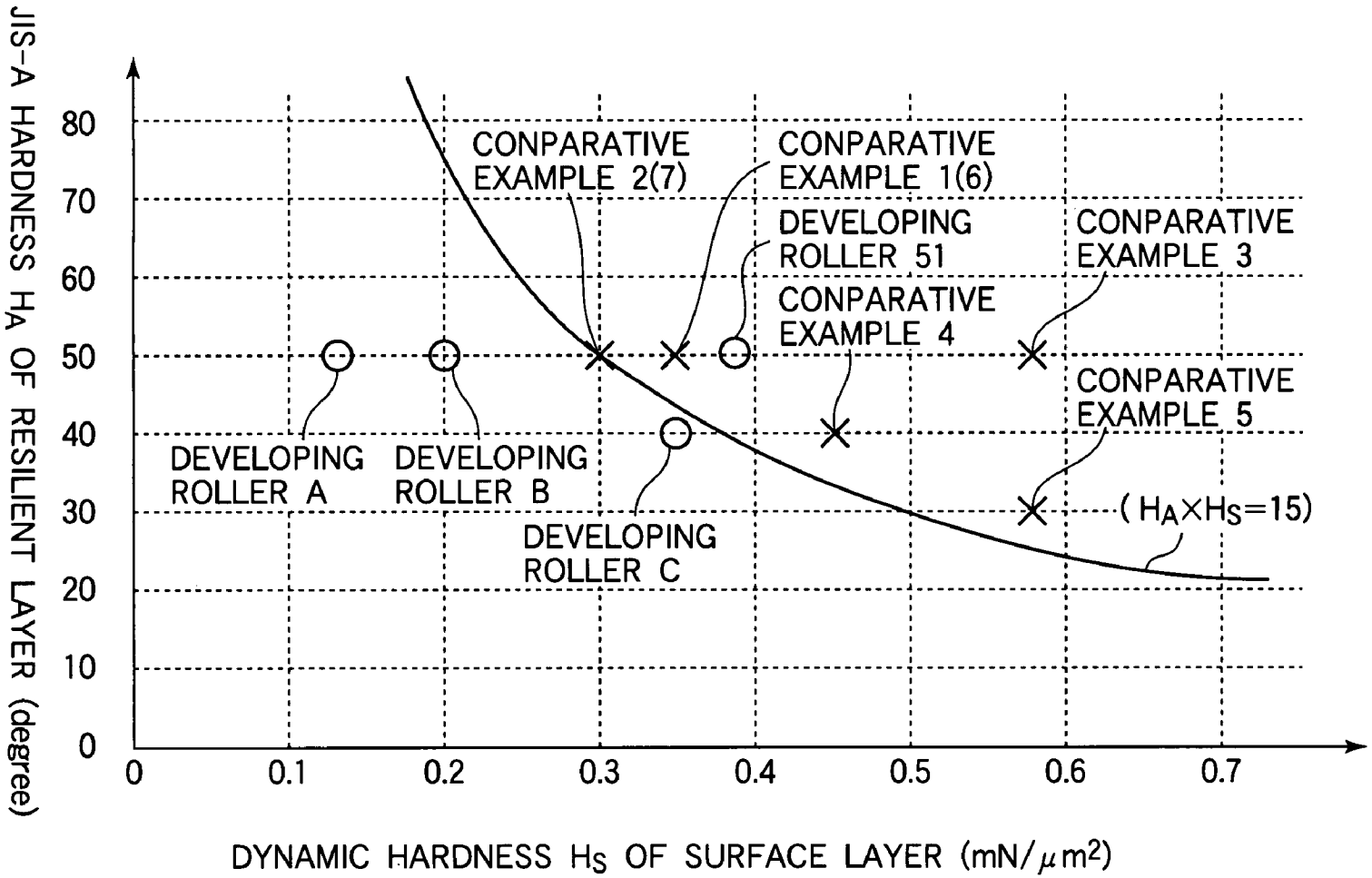
FIG. 5 is a graph illustrating a distribution of the results shown in Table 2.

FIG. 5 is a graph showing the result of Table 2. In FIG. 5, the horizontal axis indicates the dynamic hardness $H_S$ of the surface layer 6*c*, and the vertical axis indicates the JIS-A hardness $H_A$ of the resilient layer 6*b*. As shown in FIG. 5, it is understood that a region of "O" in which the filming does not occurs and a region of "X" in which the filming occurs are divided by a line that expresses $H_A \times H_S = 15$. Therefore, in order to prevent the filming, it is necessary to reduce the hardness $H_A$ of the resilient layer 6*b* and the hardness $H_S$ of the surface layer 6*c* of the developing roller 6. Alternatively, if the hardness of the surface layer 6*c* is relatively high, it is necessary to reduce the hardness $H_A$ of the resilient layer 6*b*. If the hardness $H_S$ of the surface layer 6*c* is to be reduced (for preventing the filming), it is preferable that the surface layer 6*c* is made of a rubber-like member rather than a resin coating material.

As described above, according to Embodiment 1, the JIS-A hardness $H_A$ (degree) of the resilient layer 6*b* and the dynamic hardness $H_S$ (mN/μm$^2$) of the surface layer 6*c* of the developing roller 6 satisfy the relationship $H_A \times H_S < 15$. With such an arrangement, it is possible to prevent the application of an excessive pressure to the surface of the developing roller 6, and therefore it is possible to prevent the filming of the toner on the surface of the developing roller 6.

Generally, if the particle size of the toner is reduced for the purpose of enhancing the image quality, the heat capacity and the mechanical strength of the toner may decrease, with the result that filming may easily occur. However, according to Embodiment 1, the filming can be prevented when the above described relationship $H_A \times H_S < 15$ is satisfied. Further, materials of the developing roller 6 can be selected according to the relationship $H_A \times H_S < 15$, and therefore it is smooth to select the materials of the developing roller 6.

Moreover, as shown in FIG. 1, when the dynamic hardness $H_S$ of the surface layer 6*c* is less than or equals to 0.35 mN/μm$^2$, the filming can be prevented even when a resilient layer 6*b* having a relatively high hardness is used.

Additionally, when the surface layer 6*c* is made of polyester resin (as in the developing roller A), when the surface layer 6*c* includes the first layer of polyester resin and the second layer of silicon resin (as in the developing roller B), or when the surface layer 6*c* is made by mixing polyester resin and silicon resin (as in the developing roller C), the dynamic hardness $H_S$ of the surface layer 6*c* can be reduced to less than or equals to 0.35 mN/μm$^2$.

In addition, when the resilient layer 6*b* is made of silicone rubber, the hardness of the resilient layer 6*b* can be relatively low.

Embodiment 2

Figure 6:
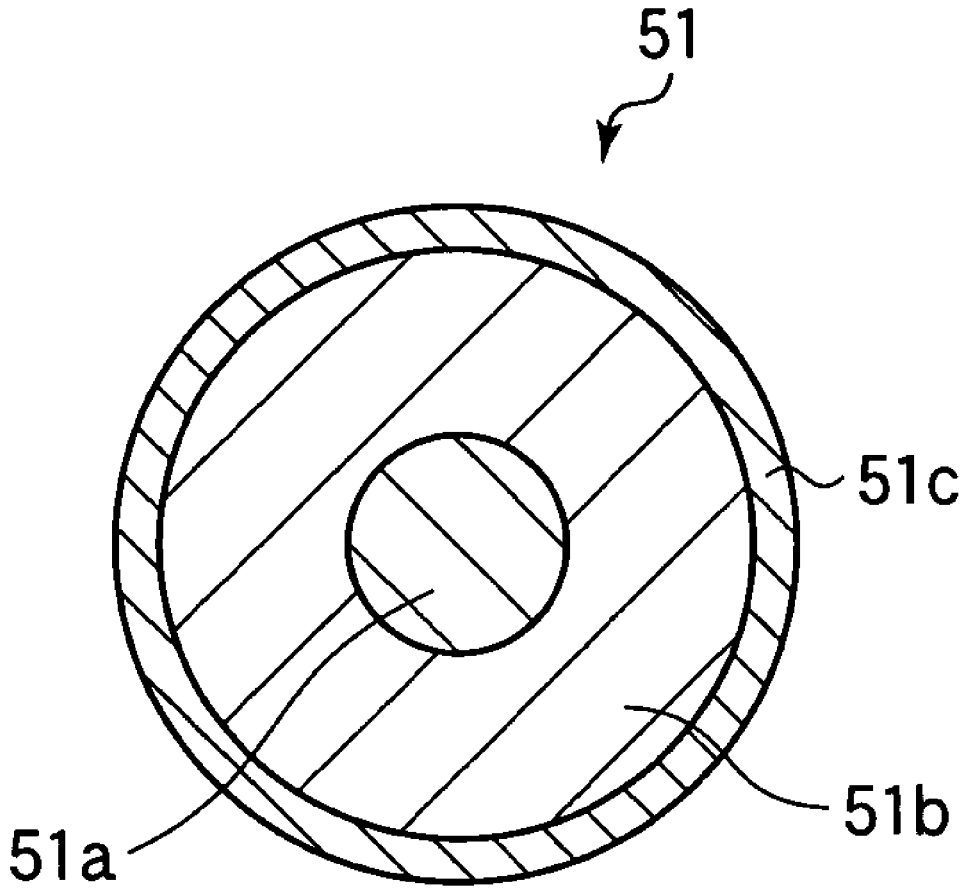
FIG. 6 is a sectional view showing an internal structure of a developing roller as a developer bearing body according to Embodiment 2 of the present invention.

FIG. 6 is a sectional view showing an internal structure of a developing roller as a developer bearing body according to Embodiment 2 of the present invention.

The developing roller 51 can be mounted in the image forming apparatus 1 (FIG. 1) instead of the developing roller 6 (FIG. 1) of Embodiment 1. In this case, components of the image forming apparatus 1 other than the developing roller 51 are the same as those described in Embodiment 1. With regard to the components similar to those in Embodiment 1, the duplicated explanation is omitted. The emphasize of the description is laid on the difference between Embodiments 1 and 2.

As shown in FIG. 6, the developing roller 51 has a core 51*a* (i.e., a rotation axis) made of metal, a resilient layer 51*b* (whose electric resistance is adjusted by dispersing a suitable amount of an electrical conductive material therein) formed around the core 51*a*, and a surface layer 51*c* formed on the surface of the resilient layer 51*b*. The surface layer 53*c* is formed by a processing using isocyanate, i.e., a compound containing the isocyanate group (—N═C═O) including nitrogen. In particular, the surface layer 51*c* is formed by impregnating the resilient layer 51*b* (formed around the core 51*a*) in a processing solution including isocyanate, and by modifying the surface of the resilient layer 51*b*. Further, the surface of the surface layer 51*c* is finished by polishing, so that minute grooves are formed on the surface layer 51*c* and extend in the circumferential direction of the developing roller 51.

An experiment with regard to the occurrence of the filming will be described. In the experiment, the developing roller 51 and its comparative examples 6 and 7 are used. The method for measuring the microhardness of the surface of the developing roller 51, and the method for checking the filming are described in Embodiment 1, and therefore the duplicate explanation is omitted.

The components of the developing roller 51 of Embodiment 2 and comparative examples 6 and 7 used in the experiment are shown in Table 3. The developing roller 51 of Embodiment 2 and the comparative examples 6 and 7 are collectively referred to as test developing rollers.

TABLE 3

| Developing Roller | Resilient Layer 51b | Surface Layer 51c |
|---|---|---|
| Developing Roller 51 | Urethane Rubber JIS-A 50 Degrees | Processing Using Isocyanate. |
| Comparative Example 6 | Silicone Rubber JIS-A 50 Degrees | Same as Comparative Example 1. |
| Comparative Example 7 | Silicone Rubber JIS-A 50 Degrees | Same as Comparative Example 2. |

Table 4 shows the JIS-A hardness $H_A$ of the resilient layer 51*b* and the dynamic hardness $H_S$ of the surface layer 51*c*, as well as the result of the determination whether the filming occurs or not after the continuous printing operation is carried out using the test developing rollers. In Table 4, "O" indicates that the filming does not occur, and "X" indicates that the filming occurs. The hardness of the surface of each test developing roller is not univocally determined by a material used for processing or coating on the developing roller, but can be adjusted by varying the density of solvent, the thickness of the coating, the adding amount of the micro particles, or the like.

TABLE 4

| Developing Roller | JIS-A Hardness $H_A$ of Resilient Layer 51b (degree) | Dynamic Hardness $H_s$ of Surface Layer 51c (mN/μm$^2$) | Generation of Filming |
|---|---|---|---|
| Developing Roller 51 | 50 | 0.38 | ○ |
| Comparative Example 6 | 50 | 0.35 | X |
| Comparative Example 7 | 50 | 0.30 | X |

The result shown in Table 4 is also shown in FIG. 5. It is understood from FIG. 5 that the filming does not occur when the developing roller 51 is used, even though the value of $H_A \times H_S$ is greater than that of the comparative example 6 or 7.

Hereinafter, a circumferential direction of the developing roller 51 is simply referred to as a "circumferential direction", and an axial direction of the developing roller 51 is simply referred to as an "axial direction".

Table 5 shows the ten-point height of roughness profile $R_{Z1}$ (μm) of the surface of the developing roller 51 (i.e., the surface layer 51*c*) in the circumferential direction, and the mean width of the profile elements $S_{m1}$ (μm) of the surface of the developing roller 51 in the circumferential direction. Table 5 also shows the ten-point height of roughness profile $R_{Z2}$ (μm) of the surface of the developing roller 51 in the axial direction and the mean width of the profile elements $S_{m2}$ (μm) of the surface of the developing roller 51 in the axial direction. The surface roughness of the developing roller 51 is measured by "Surface Roughness and Profile Measuring Device Surfcorder SEF-30D" manufactured by Kosaka Laboratory Limited, and the measuring speed is set to 0.1 mm/sec.

TABLE 5

| Developing Roller | Ten-point Height of Roughness Profile $R_{z1}$ in Circumferential Direction of Roller (μm) | Ten-point Height of Roughness Profile $R_{z2}$ in Axial Direction of Roller (μm) | Mean Width of Profile Elements $S_{m1}$ in Circumferential Direction of Roller (μm) | Mean Width of Profile Elements $S_{m2}$ in Axial Direction of Roller (μm) |
|---|---|---|---|---|
| Developing Roller 51 | 4.7 | 6.2 | 63 | 42 |
| Comparative Example 6 | 5.7 | 5.9 | 40 | 46 |
| Comparative Example 7 | 7.1 | 6.9 | 42 | 41 |

As shown in Table 5, in each of the comparative examples 6 and 7, the ten-point height of roughness profile $R_z$ and the mean width of the profile elements $S_m$ in the circumferential direction are the same as those in the axial direction. Conversely, in the developing roller 51, the ten-point height of roughness profile $R_z$ and the mean width of the profile elements $S_m$ in the circumferential direction are different from those in the axial direction. In particular, the ten-point height of roughness profile $R_z$ is larger in the axial direction ($R_{Z1}$) than in the circumferential direction ($R_{Z2}$), and the mean width of the profile elements $S_m$ (μm) is larger in the circumferential direction ($S_{m1}$) than in the axial direction ($S_{m2}$). This is because the minute grooves are formed on the surface of the surface layer 51*c* (finished by polishing) and extend in the circumferential direction of the developing roller 51.

As shown in Table 4 and FIG. 5, the filming does not occur when the developing roller 51 is used, even though the value of $H_A \times H_S$ is greater than that of the comparative example 6 or 7. This is because the pressure applied to the surface of the developing roller 51 is reduced, since the contact area of the developing roller 51 and the contact member (for example, the photosensitive drum 2) is reduced, due to the minute grooves formed on the surface of the developing roller 51.

In the developing roller 51 in which the JIS-A hardness $H_A$ (degree) of the resilient layer 51*b* and the dynamic hardness $H_S$ (mN/μm$^2$) of the surface layer 51*c* satisfy the relationship $H_A \times H_S < 20$, the filming does not occur when the ten-point heights of roughness profile $R_{Z1}$ and $R_{Z2}$ (μm) of the surface of the developing roller 51 in the circumferential direction and in the axial direction, and the mean widths of the profile elements $S_{m1}$ and $S_{m2}$ (μm) of the surface of the developing roller 51 in the circumferential direction and in the axial direction satisfy the following relationships:

$$R_{Z1}<R_{Z2}$$

$$S_{m1}-S_{m2}\geqq 15\ (\mu m)$$

As described above, according to Embodiment 2, when the ten-point heights of roughness profile $R_{Z1}$ and $R_{Z2}$ of the surface of the developing roller 51 satisfy the relationship $R_{Z1}<R_{Z2}$, and when the mean widths of the profile elements $S_{m1}$ and $S_{m2}$ of the surface of the developing roller 51 satisfy the relationship $S_{m1}-Sm_{m2}\geqq 15$ (μm), the filming can be prevented even if the value of $H_A \times H_S$ is greater than 15.

While the preferred embodiments of the present invention have been illustrated in detail, it should be apparent that modifications and improvements may be made to the invention without departing from the spirit and scope of the invention as described in the following claims.

What is claimed is:

1. A developer bearing body that supplies a developer to a latent image formed on a latent image bearing body, said developer bearing body comprising:

a rotation shaft;

a resilient layer covering said rotation shaft; and a surface layer covering said resilient layer, wherein a JIS-A hardness $H_A$ (degree) of said resilient layer and a dynamic hardness $H_S$ (mN/μm$^2$) of said surface layer satisfy the following relationship:

$$H_A \times H_S<15.$$

2. The developer bearing body according to claim 1, wherein said dynamic hardness $H_S$ (mN/μm$^2$) of said surface layer satisfies the following relationship:

$$H_S\leqq 0.35.$$

3. The developer bearing body according to claim 1, wherein said surface layer is made of polyester urethane.

4. The developer bearing body according to claim 1, wherein said surface layer comprises a first layer made of polyester urethane, and a second layer made of silicone resin covering said first layer.

5. The developer bearing body according to claim 1, wherein said surface layer is made of a mixture of polyester urethane and silicone resin.

6. The developer bearing body according to claim 1, wherein said resilient layer is made of silicone rubber.

7. The developer bearing body according to claim 1, wherein mean particle diameter of said developer is 7 μm or less.

8. A developer bearing body having a cylindrical shape and being rotatable about a rotation axis to supply a developer to a latent image formed on a latent image bearing body, said developer bearing body comprising:

a resilient layer covering said rotation axis; and a surface layer covering said resilient layer, said surface layer having grooves formed on a surface thereof and extending substantially in a circumferential direction thereof, wherein a JIS-A hardness $H_A$ (degree) of said resilient layer and a dynamic hardness $H_S$ (mN/μm$^2$) of said surface layer satisfy the following relationship:

$$H_A \times H_S<20.$$

9. The developer bearing body according to claim 8, wherein a ten-point height of roughness profile $R_{Z1}$ (μm) and a mean width of the profile elements $S_{m1}$ (μm) of said surface layer in said circumferential direction, a ten-point height of roughness profile $R_{Z2}$ (μm) and a mean width of the profile elements $S_{m2}$ (μm) of said surface layer in an axial direction of said developer bearing body satisfy the following relationship:

$$R_{Z1}<R_{Z2}$$

$$S_{m1}-S_{m2}\geqq 15\ (\mu m).$$

10. The developer bearing body according to claim 8, wherein said surface layer is formed by a processing using isocyanate.

11. A process unit comprising:

said developer bearing body according to claim 1;

a developer supply unit that supplies said developer to a surface of said developer bearing body;

a thin layer forming member that substantially contacts said developer bearing body to form a thin layer of said developer supplied to said surface of said developer bearing body;

a latent image bearing body provided in opposition to said developer bearing body, said latent image bearing body bearing a latent image on a surface thereof; and a cleaning unit that contacts said latent image bearing body and removes said developer that remains on said latent image bearing body.

12. An image forming apparatus comprising:

said process unit according to claim 11;

a transfer unit that transfers a developer image formed by said developing device on said latent image bearing body to a recording medium; and a fixing unit that fixes said developer image to said recording medium.

* * * * *